US006604888B2

(12) United States Patent
Dolan

(10) Patent No.: US 6,604,888 B2
(45) Date of Patent: Aug. 12, 2003

(54) ENERGY ABSORBING SAFETY BARRIER

(76) Inventor: Donald L. Dolan, 5 W. 900 South, Kouts, IN (US) 46347

( * ) Notice: Subject to any disclaimer, the term of this patent is extended or adjusted under 35 U.S.C. 154(b) by 0 days.

(21) Appl. No.: 10/000,026

(22) Filed: Dec. 4, 2001

(65) Prior Publication Data

US 2003/0103808 A1 Jun. 5, 2003

(51) Int. Cl.[7] ..... E01F 15/14
(52) U.S. Cl. ..... 404/6; 404/10
(58) Field of Search ..... 404/6, 10; 256/13.1

(56) References Cited

U.S. PATENT DOCUMENTS

| | | | | | |
|---|---|---|---|---|---|
| 3,661,359 | A | * | 5/1972 | Walker | 256/1 |
| 3,717,370 | A | * | 2/1973 | Walker | 293/107 |
| 3,845,936 | A | * | 11/1974 | Boedecker et al. | 256/1 |
| 3,848,853 | A | | 11/1974 | Way et al. | |
| 3,863,589 | A | * | 2/1975 | Guienne et al. | 114/219 |
| 3,934,540 | A | * | 1/1976 | Bruner et al. | 116/63 P |
| 3,982,734 | A | | 9/1976 | Walker | |
| 4,022,434 | A | | 5/1977 | Moore | |
| 4,073,482 | A | * | 2/1978 | Seegmiller et al. | 267/139 |
| 4,186,913 | A | | 2/1980 | Bruner et al. | |
| 4,288,061 | A | * | 9/1981 | Moreau | 256/13.1 |
| 4,289,419 | A | * | 9/1981 | Young et al. | 404/6 |
| 4,674,911 | A | | 6/1987 | Gertz | |
| 4,848,853 | A | | 7/1989 | Mizuno et al. | |
| 4,934,661 | A | * | 6/1990 | Denman et al. | 256/13.1 |
| 5,238,228 | A | * | 8/1993 | Moon | 256/13.1 |
| 5,480,255 | A | * | 1/1996 | Bernaquez et al. | 404/6 |
| 5,549,279 | A | * | 8/1996 | Aszkenas | 256/13.1 |
| 5,568,913 | A | | 10/1996 | Nagler | |

* cited by examiner

*Primary Examiner*—Gary S. Hartmann
(74) *Attorney, Agent, or Firm*—Shoemaker and Mattare

(57) ABSTRACT

An energy absorbing safety barrier is made of at least one horizontal stack of used tires, bolted together at the sidewalls. Both ends of the stack are closed by attached plates or an adjoining barrier. When the stack is struck axially, air escapes from the stack at a controlled rate through vents formed by forming U-shaped cuts in the tires. The vents close at the end of the impact to reduce or eliminate rebound.

17 Claims, 8 Drawing Sheets

Fig. 6
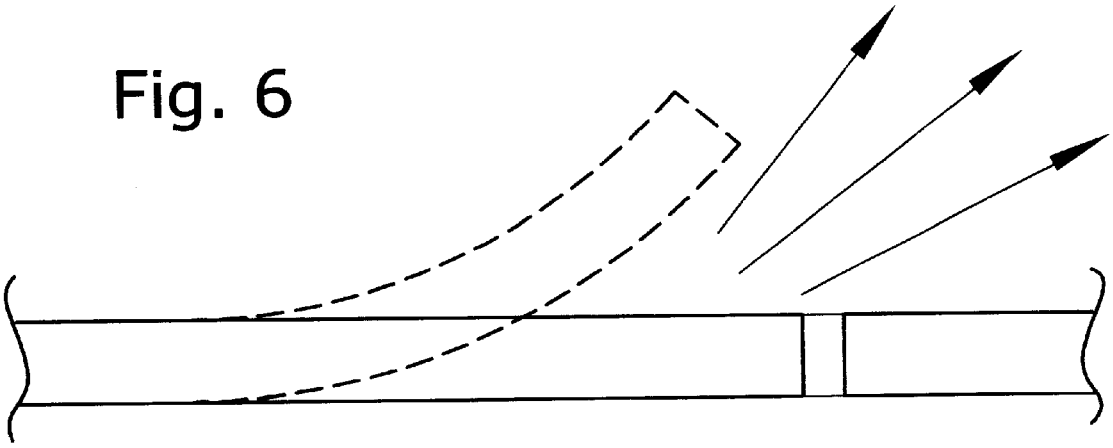
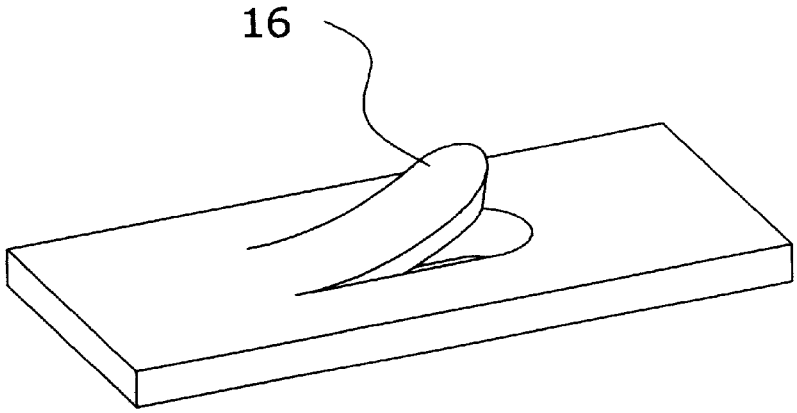
FIG. 7

ENERGY ABSORBING SAFETY BARRIER

BACKGROUND OF THE INVENTION

This invention relates to an energy absorbing safety barrier.

A number of approaches have been taken to protect vehicle drivers, and other vehicles, from accidental impacts against bridge abutments and other fixtures. Sand-filled barrels, for example, can be placed in front of such obstacles to absorb the energy of a vehicle upon impact over a greater distance than if the obstacle were directly struck. Doing so reduces the maximum deceleration of the vehicle, and thus improves the chances for surviving such an accident. Old vehicle tires have been used as barrier for years at auto races, and along piers.

Pneumatic energy absorbers have also been proposed. They tend, however, to be more expensive than the simpler solutions, and they create a new problem of rebound: a pneumatic barrier can act as a spring, redirecting a vehicle back into traffic in a direction opposed to the general flow of traffic. Rebounds of this type are potentially fatal.

Prior inventors have addressed the problem of absorbing the tremendous impacts which vehicles traveling at high speed can produce. U.S. Pat. No. 4,674,911 describes a cushion made of accordion-type members, and has valves to control air release upon impact. U.S. Pat. No. 4,848,853 discloses a highway impact device made of tires stacked vertically.

The need remains, however, for an device which can absorb great vehicle impacts, minimizes rebound, and is also inexpensive to construct.

SUMMARY OF THE INVENTION

An object of the invention is to provide a device which can safely arrest vehicles in high-speed impacts.

A related object is to prevent vehicle rebound after impact.

A further object is to provide a device which can be constructed largely from materials which are free or at least very inexpensive.

These and other objects are attained by an energy absorbing safety barrier formed from pneumatic tires, as described below.

According to the present invention, tires are formed into horizontal stacks, bound together permanently at the sidewalls. Plates at either end of the stack form sealed chambers, normally at atmospheric pressure. When the stack is struck by a vehicle, it absorbs energy primarily through the mechanism of air compression within the stack, as in an air bag, rather than from the resiliency of the tires themselves. Rebound is minimized by allowing air to escape through vent valves which substantially close as the stack expands following an impact.

BRIEF DESCRIPTION OF THE DRAWINGS

In the accompanying drawings,

FIG. 6 is an enlarged detail of a portion of a representative tire, showing a vent flap therein;

FIG. 7 shows a preferred form of one vent flap;

DESCRIPTION OF THE PREFERRED EMBODIMENT

Figure 1:
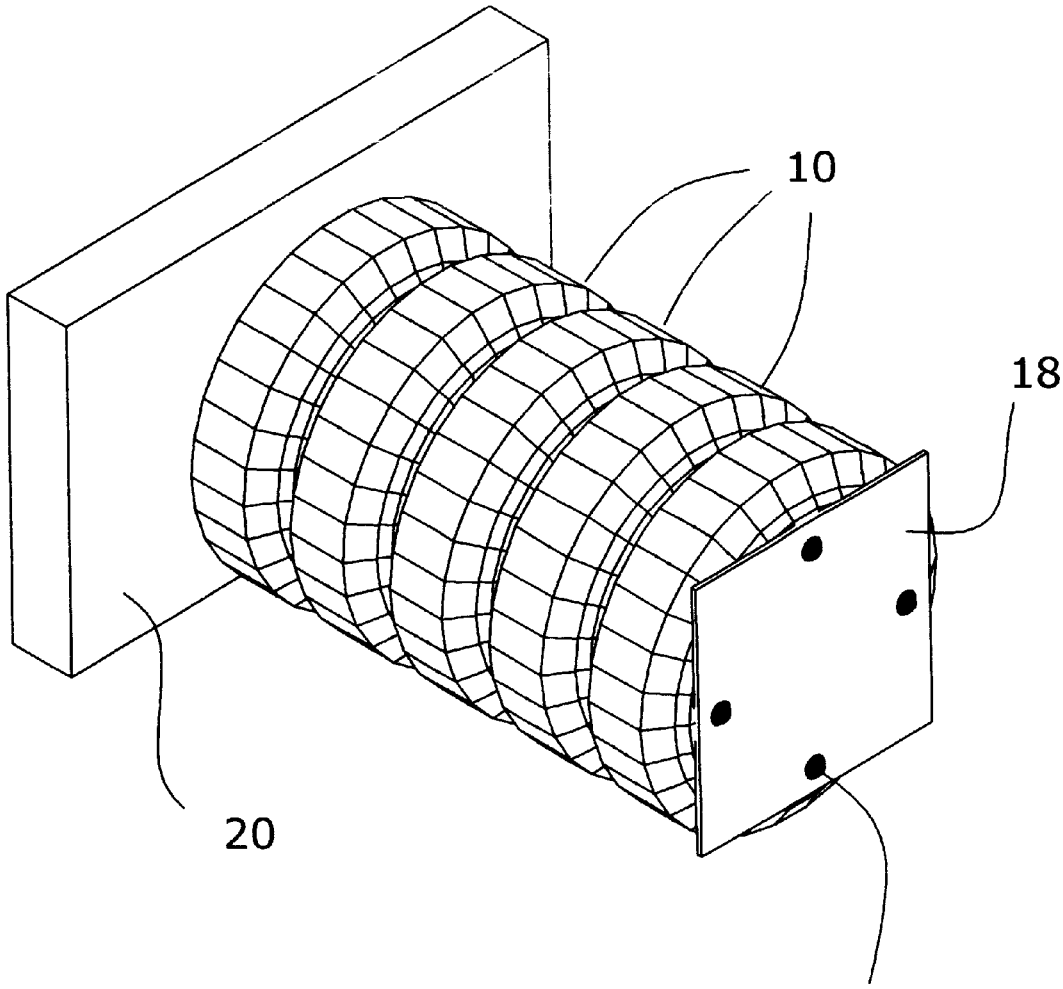
FIG. 1 is a perspective view of an energy absorbing safety barrier embodying the invention.
Figure 2:
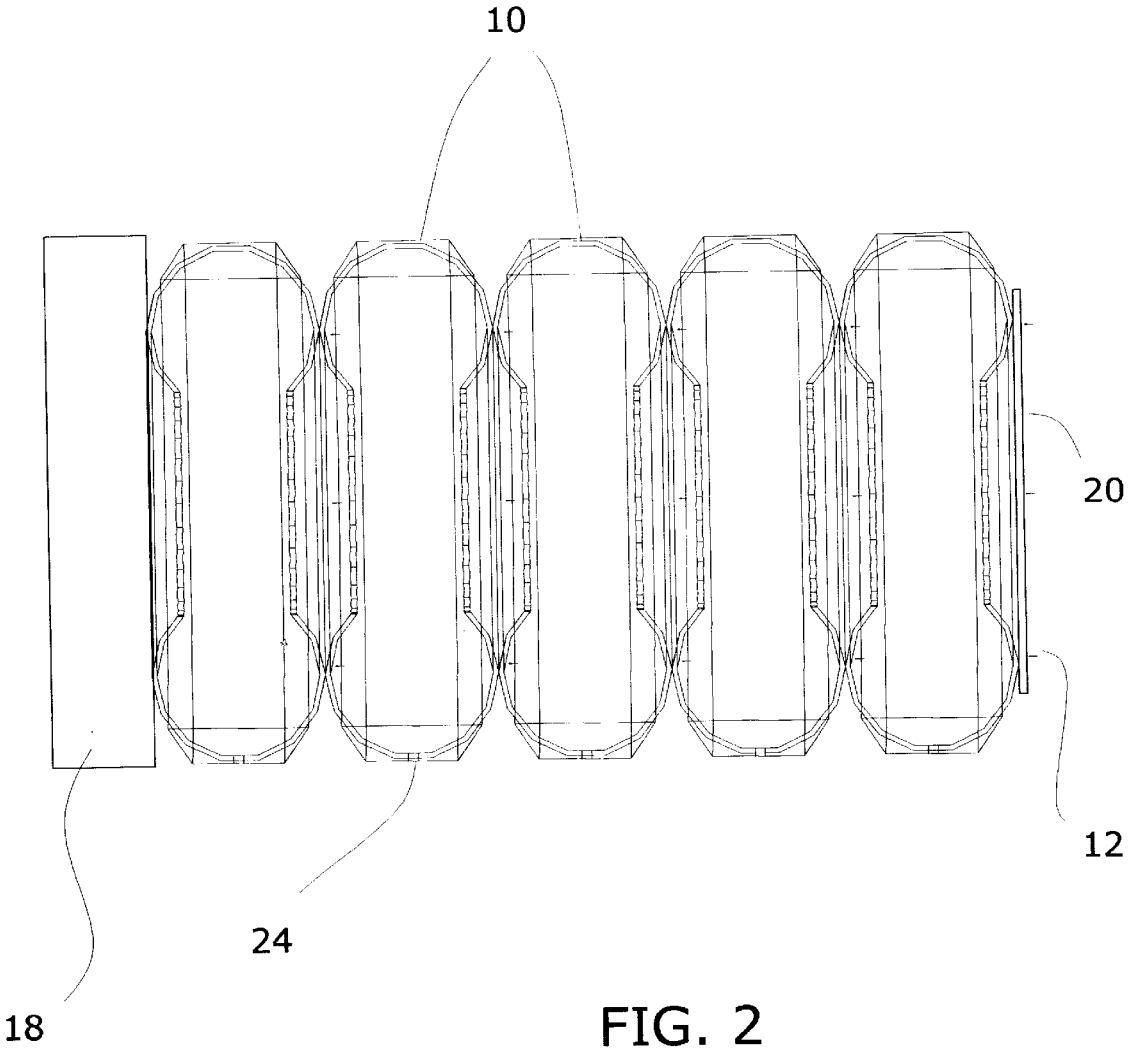
FIG. 2 is a section on a vertical plane axially bisecting the barrier.

An energy absorbing safety barrier embodying the invention is formed from a horizontal stack of tires 10, as shown in FIG. 1. Raised lettering and the like should be removed from the sidewalls so that they can seal against one another. The tires are attached together at the sidewalls by fasteners. Hex bolts 12 with fender washers 14 are the fasteners exemplified in FIG. 2. Other fasteners are shown in FIGS. 8 and 9, discussed below.

Figure 3:
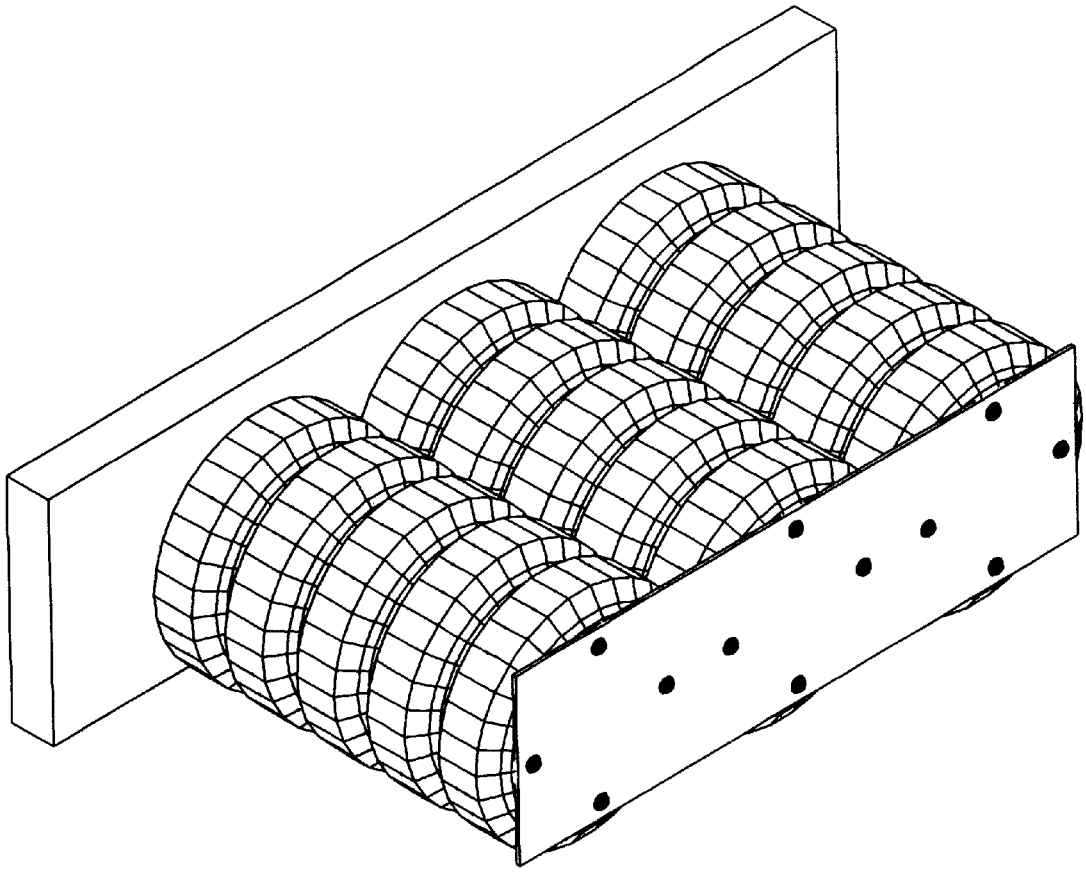
FIG. 3 is a perspective view of a barrier comprising plural like stacks of tires.

The stack of tires is placed against a vertical obstacle 18 such as a Jersey wall. A barrier plate 20 bolted to the outer end of each stack prevents air from escaping from the interior of the stack and acts as an impact receiver when the stack is struck from the front. The barrier plate may be made, for example, from UHMW (ultra-high molecular weight) polyethylene a quarter to a half inch thick. Polyethylene is advantageous because it presents a low coefficient of friction, which reduces the likelihood of producing a spin in a car which strikes the stack a glancing blow. If plural stacks of tires are used in a single barrier, one barrier plate may span all the stacks, as shown in FIG. 3.

The tires have vents 16 (see details, FIGS. 6 and 7) cut in their sidewalls to allow controlled air escape from within the tires when the barrier is struck along the tires' common axis "A". The vents may be located in the tires so that air jets escaping from them are directed at the barrier plate, or away from the impacting vehicle direction, as desired.

The vents preferably are formed as valves which open when air pressure within the stack is substantial, and close thereafter to minimize rebound. Most preferably, they are formed by making U-shaped cuts in the sides or treads of the tires, so that a flap is created. Normally, the flap remains in its original orientation. However, when pressure builds inside the stack during an impact, the flaps open and release air through the apertures thus exposed. The exact size, shape and number of the cuts will depend on the size and number of tires used, and the anticipated maximum impact energy. In a typical automotive application each tire in the stack may have four U-shaped vents, where the "U" is one and a half inches wide, and one and a half inches tall. The cuts may be made perpendicular to the surface of the tire, as in FIG. 6, but I prefer that they be at an oblique angle, most preferably about 50° to the outer surface, tapering toward the center of the vent. This construction is shown in FIG. 7. Tapered vents seat like a poppet valve, and cannot pass center to reopen during the stack expansion cycle. Other valve constructions, including simple linear slits are possible, but the constructions shown in FIGS. 6 and 7 are presently preferred.

A one-inch diameter water drain hole 24 (FIG. 2) should be punched out at the bottom of each tire, to prevent build-up of water, which might otherwise freeze or interfere with the release of air from the vents. During an impact, air escaping through the hole lifts the tire, breaking frictional contact with the ground, allowing the stack to compress evenly.

Alternatively, or in addition, the stack may be enveloped with a plastic (e.g., vinyl) covering to keep water from getting into the tires, and to enhance the appearance of the barrier.

Figure 4:
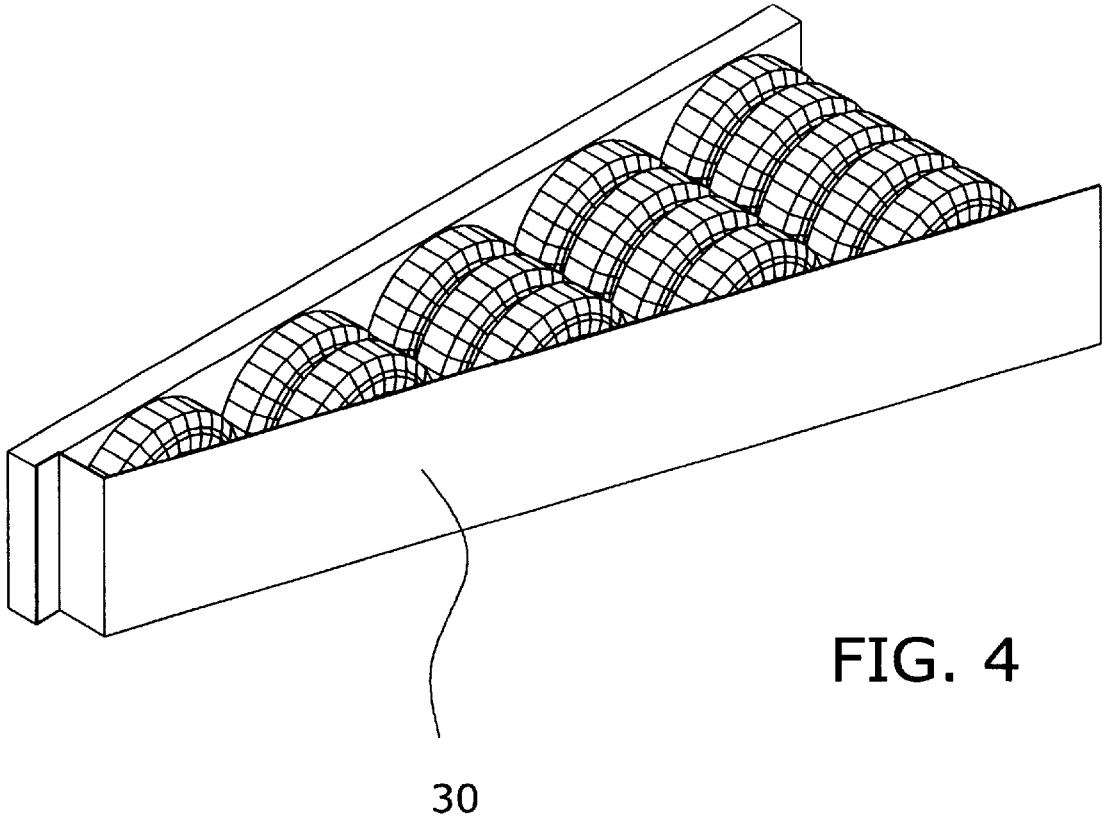
FIG. 4 is a perspective view of a barrier comprising progressively longer stacks of tires.

In situations where glancing blows are expected, for example, along drag strips, several stacks of progressively greater height may be installed along an obstacle parallel to the track, as shown in FIG. 4. An oblique impact plate 30 is placed in front of the stacks, to distribute any impacts and to reduce friction with the vehicle, so as not to induce a spin. This plate may be made of UHMW polyethylene, as mentioned above, or another suitable polymeric material such as Lexan™, Tyveck™, Plexiglas 90, or the like.

Figure 5:
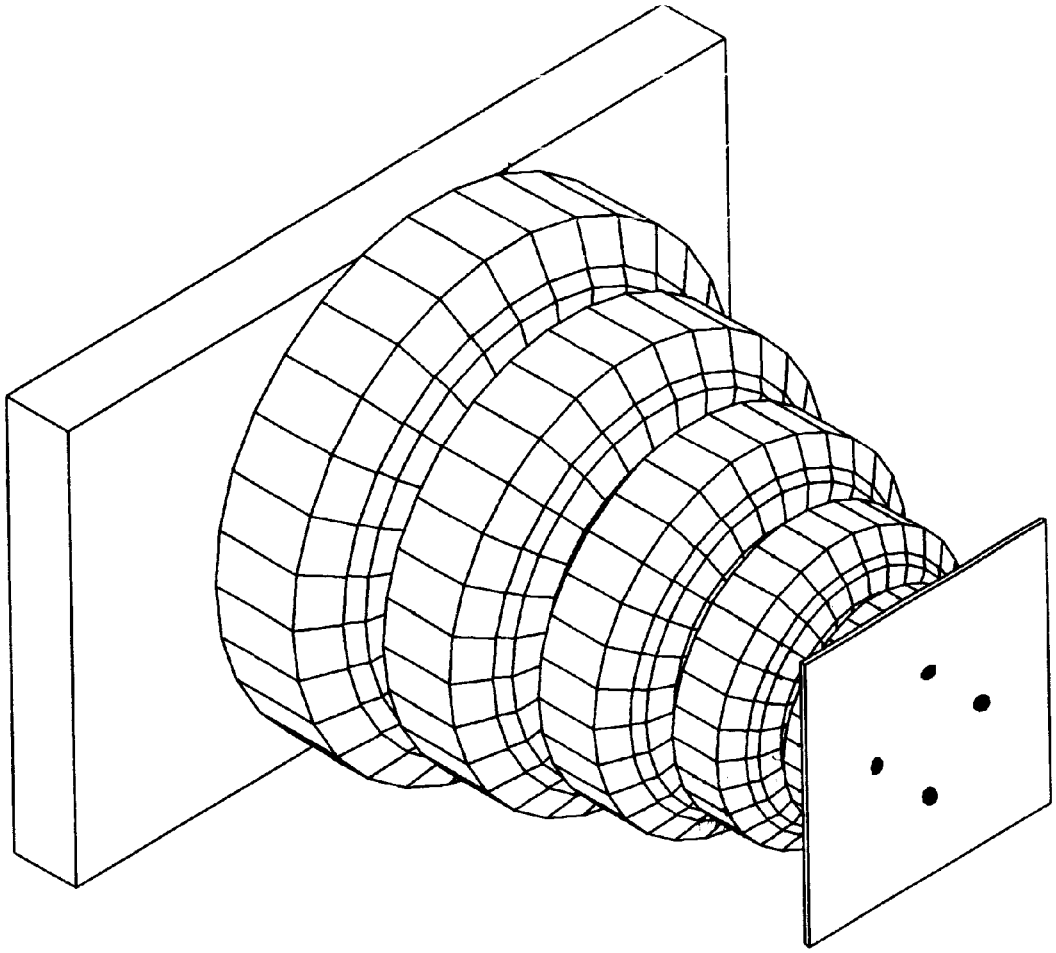
FIG. 5 is a perspective view of a barrier having a single stack of tires of different diameters.

The tires in each stack may be identical, or a random assortment, or they may be arranged from largest to smallest to form a progressive device (FIG. 5). Particularly large tires (airplane tires, earthmover tires, etc.) may be useful in ultra-high impact environments. Although it is not necessary, one may grind the treads of the tires before using them, to reduce their weight, improve their flexibility, and improve their appearance. Raised sidewall lettering may also be ground off to eliminate air gaps between tires.

Figure 8A:
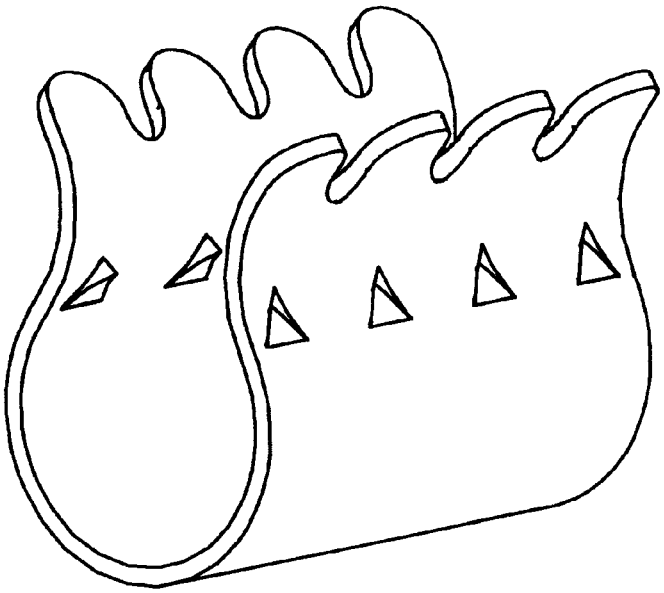
FIGS. 8A and 8B show a tire bead clip for holding tire beads together in a stack.
Figure 8B:
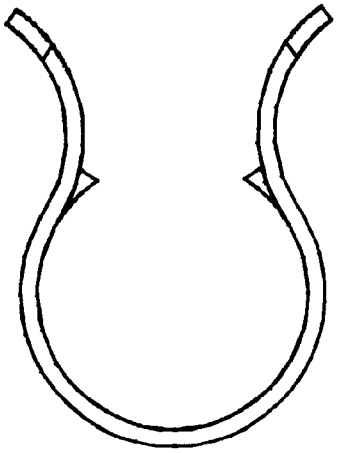

The fastener shown in FIGS. 8A and 8B is pushed over the beads of adjacent tires to hold them together, bead-to-bead. This fastener is simple to apply, and avoids the need to drill bolt holes in the sidewalls.

Figure 9A:
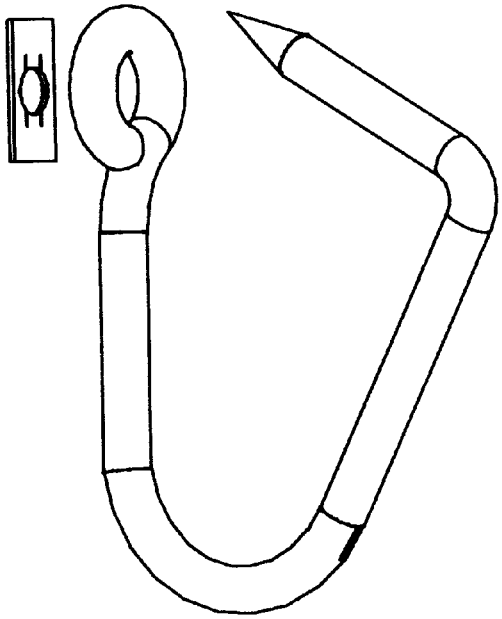
FIGS. 9A and 9B illustrate an alternative fastener, particularly useful for holding together tires of different sizes.
Figure 9B:
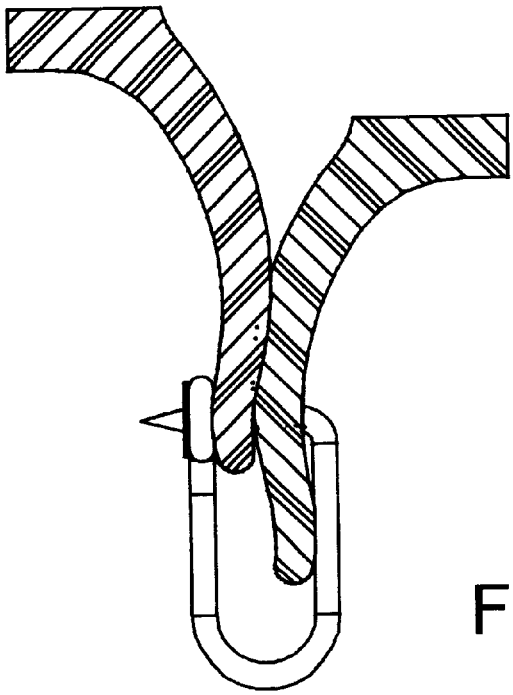

The fastener shown in FIGS. 9A and 9B is a ring having a pointed end which passes through an eye formed at the other end. A clip nut is applied to retain the pointed end within the eye, after the fastener is applied. The clip nut seats in a circumferential groove at the pointed end.

It should be appreciated that this invention is useful for cushioning the impacts of not just automobiles, but in fact all large moving objects, including trains, ships and airplanes.

The present invention provides not only a useful, inexpensive solution to an important safety problem, but also a good alternative to costly tire disposal.

Since the invention is subject to modifications and variations, it is intended that the foregoing description and the accompanying drawings shall be interpreted as only illustrative of the invention defined by the following claims.

I claim:

1. An energy absorbing safety barrier comprising a plurality of pneumatic vehicle tires having sidewalls, said tires being arranged in at least one stack with the sidewalls of adjacent tires attached to one another at the sidewalls, and a pair of end structures to close off the ends of the endmost tires in the stack, thus forming a closed air chamber, said stack being placed substantially horizontally and aligned toward traffic, and one or more vent valves for controlling air flow into and out of the chamber, to absorb energy while cushioning impact of a vehicle and to minimize rebound of the vehicle, wherein each of said vents comprises a hinged flap formed from the sidewall of its respective tire.

2. The invention of claim 1, wherein the tires are connected to one another by mechanical fasteners.

3. The invention of claim 2, wherein at least some of said fasteners are rings having an eye at one end through which an opposite end of the ring may be passed, and means for retaining the opposite end within the eye.

4. The invention of claim 2, wherein at least some of said fasteners are clips which may be pushed over adjoining tire beads, each said clip comprising teeth facing inward to dig into the tire bead and hold the clips in place.

5. The invention of claim 1, wherein one of said end structures is an obstacle fixed to the ground.

6. The invention of claim 1, wherein one of said end structures is a massive structure resting on the ground.

7. The invention of claim 1, wherein one of said structures is an end plate attached to an endmost one of said tires.

8. The invention of claim 7, wherein said end plate is formed of a polymeric material.

9. The invention of claim 8, wherein the polymeric material is ultra-high molecular weight polyethylene.

10. The invention of claim 1, wherein said tires are arranged in more than one stack and the stacks are arranged adjacent one another.

11. The invention of claim 10, wherein a common end plate is attached to an endmost tire of each of said stacks.

12. The invention of claim 10, wherein said stacks have a progressive number of tires.

13. The invention of claim 1, wherein the edge and seat make an angle of about 50° to the sidewall's surface.

14. The invention of claim 1, further comprising a covering for preventing rain water from accumulating in said tires.

15. The invention of claim 1, wherein the flap is U-shaped.

16. The invention of claim 1, wherein the flap has a tapered edge which engages a correspondingly tapered seat to prevent reverse flow of air into the tire.

17. An energy absorbing safety barrier comprising a plurality of pneumatic vehicle tires having sidewalls said tires being arranged in at least one stack with the sidewalls of adjacent tires attached to one another at the sidewalls, and a pair of end structures to close off the ends of the endmost tires in the stack, thus forming a closed air chamber, said stack being placed substantially horizontally and aligned toward traffic, and one or more vent valves for controlling air flow into and out of the chamber, to absorb energy while cushioning impact of a vehicle and to minimize rebound of the vehicle, wherein each of said tires has a hole formed in its tread at the bottom thereof to prevent water from accumulating in said tires.

* * * * *